US011255063B2

(12) United States Patent
Washington

(10) Patent No.: US 11,255,063 B2
(45) Date of Patent: Feb. 22, 2022

(54) BOUNCE HOUSE SECURING ASSEMBLY

(71) Applicant: Della Washington, Sparks, NV (US)

(72) Inventor: Della Washington, Sparks, NV (US)

( * ) Notice: Subject to any disclaimer, the term of this patent is extended or adjusted under 35 U.S.C. 154(b) by 0 days.

(21) Appl. No.: 16/866,644

(22) Filed: May 5, 2020

(65) Prior Publication Data

US 2021/0348351 A1 Nov. 11, 2021

(51) Int. Cl.

| | |
|---|---|
| ***E02D 5/80*** | (2006.01) |
| ***A63G 31/12*** | (2006.01) |
| ***A63B 6/02*** | (2006.01) |
| ***E04H 15/20*** | (2006.01) |
| ***E04H 15/62*** | (2006.01) |

(52) U.S. Cl.

CPC ..... *E02D 5/80* (2013.01); *A63G 31/12* (2013.01); *A63B 6/02* (2013.01); *E04H 15/20* (2013.01); *E04H 15/62* (2013.01)

(58) Field of Classification Search

CPC ..... E02D 5/80; E04H 12/2269; E04H 15/62; E04H 15/20; A63G 31/12; A63B 2225/62; A63B 6/02

USPC ..... 52/155, 166, 158, 159, 162, DIG. 11

See application file for complete search history.

(56) References Cited

U.S. PATENT DOCUMENTS

| | | | | |
|---|---|---|---|---|
| 4,559,747 | A * | 12/1985 | Engel | B65F 1/141 248/907 |
| 5,461,755 | A * | 10/1995 | Hardigg | A45C 13/26 16/438 |
| 6,360,445 | B1 * | 3/2002 | Haas | B44D 3/38 33/1 LE |
| 6,981,680 | B1 | 1/2006 | Gordon | |
| 7,213,869 | B1 * | 5/2007 | McClellan | E04H 12/2238 248/346.01 |
| D671,397 | S * | 11/2012 | McLaughlin | D8/388 |
| 8,312,888 | B2 | 11/2012 | Rees, Jr. | |
| D711,698 | S | 8/2014 | Tscharner | |
| 9,404,282 | B2 | 8/2016 | Andrews | |
| 9,869,111 | B1 * | 1/2018 | Bailey, Sr. | F16M 13/00 |
| D851,195 | S * | 6/2019 | Anderson | D21/839 |
| 10,357,723 | B1 * | 7/2019 | Webster | A63G 31/12 |
| 2004/0099300 | A1 | 5/2004 | Warren | |

(Continued)

FOREIGN PATENT DOCUMENTS

WO WO2007031768 3/2007

*Primary Examiner* — Basil S Katcheves
*Assistant Examiner* — Omar F Hijaz

(57) ABSTRACT

A bounce house securing assembly includes a plurality of blocks that is each of the blocks is comprised of a weighted material such that each of the blocks has a weight of at least 40.0 pounds. In this way the plurality of blocks have sufficient weight to inhibit a bounce house from becoming airborne. A plurality of top handles is each coupled to a respective one of the blocks thereby facilitating the respective blocks to be carried. A plurality of side handles is each movably coupled to a respective one of the blocks thereby facilitating the respective block to be carried. A plurality of spikes is each of the spikes is coupled to and extends downwardly from a respective one of the blocks for penetrating a support surface to inhibit the respective block from moving on the support surface. Each of the spikes is extendable through a respective one of a plurality of securing loops on the bounce house to anchor the bounce house to the support surface.

1 Claim, 3 Drawing Sheets

(56) References Cited

U.S. PATENT DOCUMENTS

| | | | | |
|---|---|---|---|---|
| 2005/0029410 | A1* | 2/2005 | Walker | F16L 3/003 248/80 |
| 2006/0211507 | A1* | 9/2006 | Demirdjian | E04H 15/62 472/134 |
| 2008/0307721 | A1* | 12/2008 | Schultz | E04H 12/2215 52/157 |
| 2011/0180679 | A1* | 7/2011 | Ma | G09F 15/0056 248/346.01 |
| 2012/0017960 | A1 | 1/2012 | Doell | |
| 2020/0175896 | A1* | 6/2020 | Kyle | F16B 2/065 |

* cited by examiner

BOUNCE HOUSE SECURING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to securing devices and more particularly pertains to a new securing device for anchoring a bounce house to the ground.

(2) Description of Related Art Including Information Disclosed Under 37 CFR 1.97 and 1.98

The prior art relates to securing devices and the prior art discloses a plurality of weights that each having a plurality of stake holes therein for receiving a tent stake. The prior art discloses a canopy leg anchor that has a weighted object positioned thereon for securing legs of a canopy. The prior art also discloses a canopy leg anchor that has a plurality of stake holes therein for receiving a stake to secure the canopy leg. The prior art discloses a tent stake assembly that includes a sheath for storing a tent stake.

BRIEF SUMMARY OF THE INVENTION

An embodiment of the disclosure meets the needs presented above by generally comprising a plurality of blocks that is each of the blocks is comprised of a weighted material such that each of the blocks has a weight of at least 40.0 pounds. In this way the plurality of blocks have sufficient weight to inhibit a bounce house from becoming airborne. A plurality of top handles is each coupled to a respective one of the blocks thereby facilitating the respective blocks to be carried. A plurality of side handles is each movably coupled to a respective one of the blocks thereby facilitating the respective block to be carried. A plurality of spikes is each of the spikes is coupled to and extends downwardly from a respective one of the blocks for penetrating a support surface to inhibit the respective block from moving on the support surface. Each of the spikes is extendable through a respective one of a plurality of securing loops on the bounce house to anchor the bounce house to the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
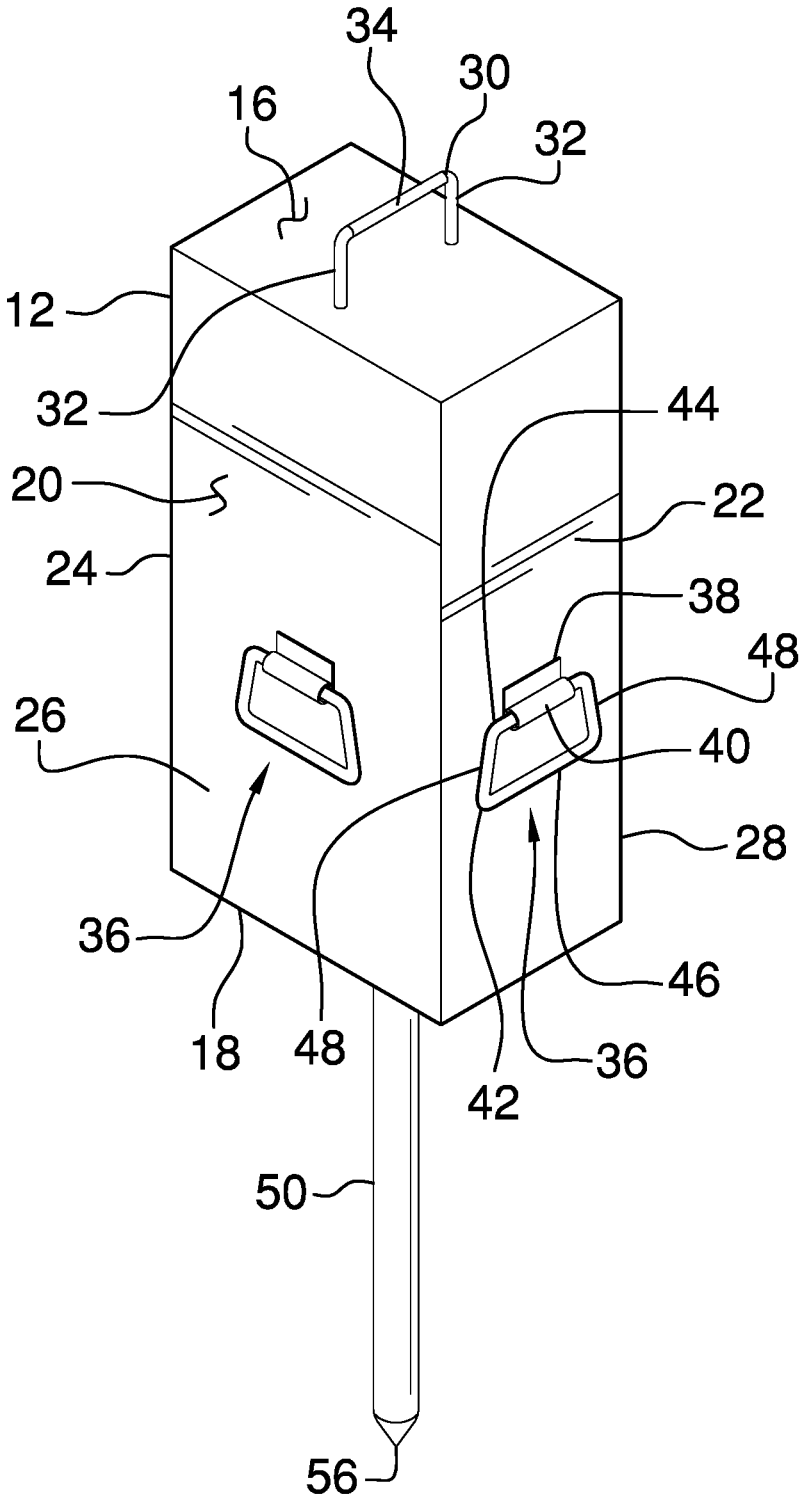
FIG. 1 is a perspective view of a bounce house securing assembly according to an embodiment of the disclosure.
Figure 2:
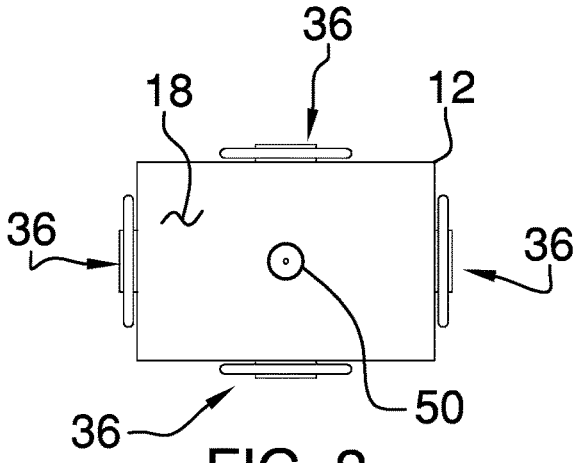
FIG. 2 is a bottom view of an embodiment of the disclosure.
Figure 3:
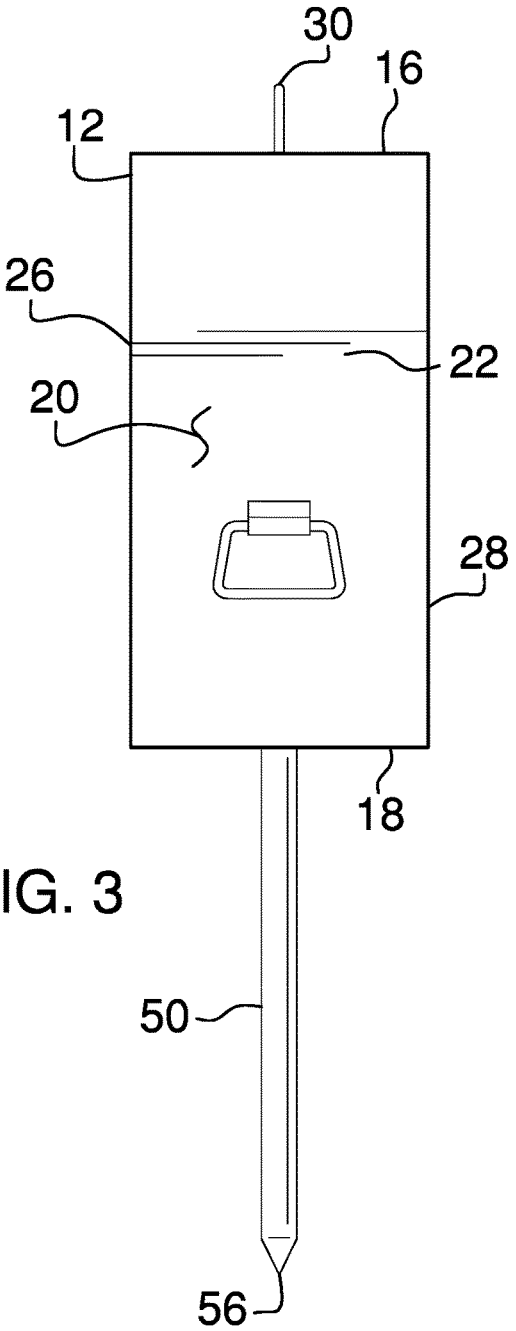
FIG. 3 is a front view of an embodiment of the disclosure.
Figure 4:
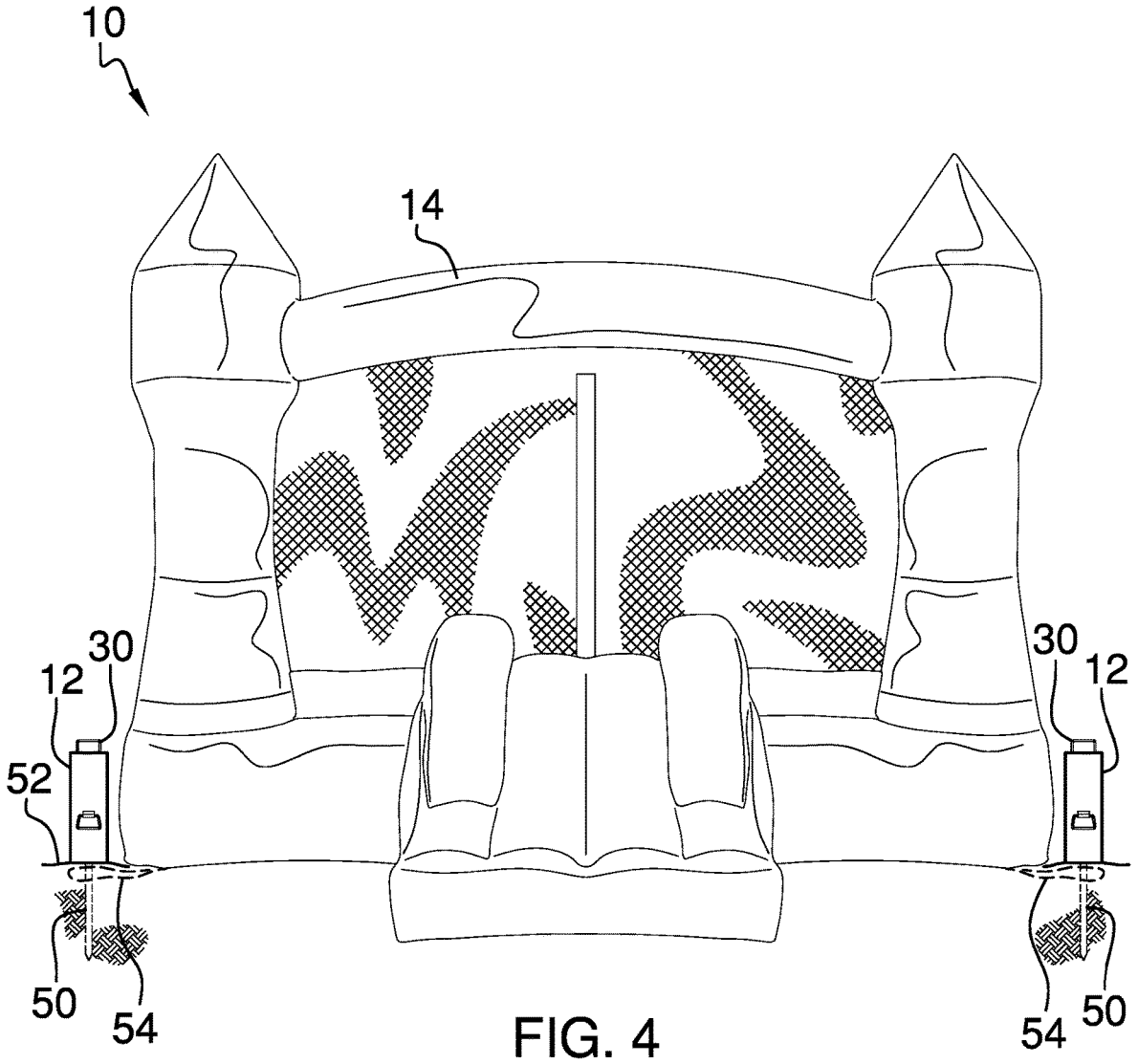
FIG. 4 is a perspective in-use view of an embodiment of the disclosure.

With reference now to the drawings, and in particular to FIGS. 1 through 4 thereof, a new securing device embodying the principles and concepts of an embodiment of the disclosure and generally designated by the reference numeral 10 will be described.

As best illustrated in FIGS. 1 through 4, the bounce house securing assembly 10 generally comprises a plurality of blocks 12 that is each comprised of a weighted material, including but not being limited to concrete, such that each of the blocks 12 has a weight of at least 40.0 pounds. In this way the plurality of blocks 12 has sufficient weight to inhibit a bounce house 14 from becoming airborne. The bounce house 14 may be an inflatable bounce house of any conventional design that is commonly employed to entertain children. Each of the blocks 12 has a top surface 16, a bottom surface 18 and an outer surface 20 extending therebetween, and the outer surface 20 has a front side 22, a back side 24, a first lateral side 26 and a second lateral side 28. Additionally, each of the blocks 12 may be elongated between the top surface 16 and the bottom surface 18.

A plurality of top handles 30 is provided and each of the top handles 30 is coupled to a respective one of the blocks 12 thereby facilitating the respective blocks 12 to be carried. Each of the top handles 30 is positioned on the top surface 16 of the respective block 12. Moreover, each of the top handles 30 comprises a pair of upright members 32 and a medial member 34 extending between the upright members 32. Each of the upright members 32 is coupled to and extends upwardly from the top surface 16 of the respective block 12 and the medial member 34 is spaced from the top surface 16 for gripping.

A plurality of side handles 36 is included and each of the side handles 36 is movably coupled to a respective one of the blocks 12 thereby facilitating the respective block 12 to be carried. Each of the side handles 36 is positioned on the outer surface 20 of the respective block 12. Additionally, each of the side handles 36 is positioned on a respective one of the first lateral side 26, the second lateral side 28, the front side 22 and the back side 24 of the outer surface 20 of the respective block 12.

Each of the side handles 36 comprises a mount 38 that has a channel 40 integrated therein and the mount 38 is positioned on the outer surface 20 of the respective block 12. Moreover, the channel 40 is oriented to extend along a horizontal line. Each of the side handles 36 includes a grip 42 that has a top member 44, a bottom member 46 and a pair of lateral members 48 each extending between the top member 44 and the bottom member 46. The bottom member 46 has a length that is greater than the length of the top member 44 such that the grip 42 has a trapezoidal shape. Moreover, the top member 44 extends through the channel 40 in the mount 38 such that the grip 42 is movably retained on the respective block 12.

A plurality of spikes 50 is provided and each of the spikes 50 is coupled to and extends downwardly from a respective one of the blocks 12. In this way each of the spikes 50 can penetrate a support surface 52 to inhibit the respective block 12 from moving on the support surface 52. Each of the spikes 50 is extendable through a respective one of a plurality of securing loops 54 on the bounce house 14 prior to inserting the spikes 50 into the support surface 52. In this way each of the spikes 50 anchors the bounce house 14 to the support surface 52. Thus, the bounce house 14 is inhibited from becoming airborne due to wind that could potentially injure or kill the children playing inside the bound house. Each of the spikes 50 extends downwardly from the bottom surface 18 of the respective block 12 and each of the spikes 50 has a distal end 56 with respect to the bottom surface 18. The distal end 56 of each of the spikes 50 tapers to a point for enhancing penetrating the support surface 52.

In use, the bounce house 14 is positioned in a desired location and each of the securing loops 54 is positioned around a respective one of the spikes 50. Each of the spikes 50 is driven into the support surface 52 until the respective block 12 rests on the support surface 52. In this way the bounce house 14 is anchored to the support surface 52. The bounce house 14 is inflated when the spikes 50 are driven into the support surface 52. In this way the health and safety of the children playing in the bounce house 14 is enhanced by inhibiting the bounce house 14 from becoming airborne due to high winds.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bounce house securing system for inhibiting a bounce house from becoming airborne from wind, said system comprising:

a bounce house being inflatable wherein said bounce house is configured to be played in by a plurality of users, said bounce housing having four corners, said bounce house having a plurality of securing loops being coupled thereto, each of said securing loops being aligned with a respective one of said four corners;

a plurality of blocks, each of said blocks being comprised of a weighted material such that each of said blocks has a weight of at least 40.0 pounds to have sufficient weight to inhibit said bounce house from becoming airborne wherein said plurality of blocks is configured to enhance safety for the users playing in said bounce house, each of said blocks having a top surface, a bottom surface and an outer surface extending therebetween, said outer surface having a front side, a back side, a first lateral side and a second lateral side;

a plurality of top handles, each of said top handles being coupled to a respective one of said blocks thereby facilitating said respective blocks to be carried, each of said top handles being positioned on said top surface of said respective block, each of said top handles comprising a pair of upright members and a medial member extending between said upright members, each of said upright members being coupled to and extending upwardly from said top surface of said respective block having said medial member being spaced from said top surface wherein said medial member is configured to be gripped;

a plurality of side handles, each of said side handles being movably coupled to a respective one of said blocks thereby facilitating said respective block to be carried, each of said side handles being positioned on said outer surface of said respective block, each of said side handles being positioned on a respective one of said first lateral side, said second lateral side, said front side and said back side of said outer surface of said respective block, each of said side handles comprising:

a mount having a channel being integrated therein, said mount being positioned on said outer surface of said respective block; and a grip having a top member, a bottom member and a pair of lateral members each extending between said top member and said bottom member, said bottom member having a length being greater than the length of said top member such that said grip has a trapezoidal shape, said top member extending through said channel in said mount such that said grip is movably retained on said respective block; and a plurality of spikes, each of said spikes being coupled to and extending downwardly from a respective one of said blocks wherein each of said spikes is configured to penetrate a support surface to inhibit said respective block from moving on the support surface, each of said spikes being extendable through a respective one of said securing loops on said bounce house prior to inserting said spikes into the support surface wherein each of said spikes is configured to anchor said bounce house to the support surface, each of said spikes extending downwardly from said bottom surface of said respective block, each of said spikes having a distal end with respect to said bottom surface, said distal end of each of said spikes tapering to a point for enhancing penetrating the support surface.

* * * * *